US009531099B2

(12) United States Patent
Convert et al.

(10) Patent No.: US 9,531,099 B2
(45) Date of Patent: Dec. 27, 2016

(54) HIGH-DENSITY CONNECTOR

(75) Inventors: Nicolas Convert, Gex (FR); Jean-Marie Buchilly, Bottens (CH); Stéphane Rohrbach, Ballens (CH)

(73) Assignee: FISCHER CONNECTORS HOLDING S.A., Saint-Prex (CH)

( * ) Notice: Subject to any disclaimer, the term of this patent is extended or adjusted under 35 U.S.C. 154(b) by 0 days.

(21) Appl. No.: 14/114,664

(22) PCT Filed: Apr. 23, 2012

(86) PCT No.: PCT/IB2012/052031

§ 371 (c)(1),
(2), (4) Date: Oct. 29, 2013

(87) PCT Pub. No.: WO2012/147023

PCT Pub. Date: Nov. 1, 2012

(65) Prior Publication Data

US 2014/0073164 A1 Mar. 13, 2014

(30) Foreign Application Priority Data

Apr. 29, 2011 (CH) ..... 00731/11

(51) Int. Cl.

| | |
|---|---|
| ***H01R 13/28*** | (2006.01) |
| ***H01R 13/03*** | (2006.01) |
| ***H01R 13/514*** | (2006.01) |
| ***H01R 24/60*** | (2011.01) |
| ***H01R 24/84*** | (2011.01) |
| ***H01R 43/16*** | (2006.01) |

(52) U.S. Cl.

CPC ..... *H01R 13/035* (2013.01); *H01R 13/28* (2013.01); *H01R 13/514* (2013.01); *H01R 24/60* (2013.01); *H01R 24/84* (2013.01); *H01R 43/16* (2013.01); *Y10T 29/49213* (2015.01)

(58) Field of Classification Search

CPC ..... H01R 13/035; H01R 13/28; H01R 13/514; H01R 23/27; H01R 24/60; H01R 24/84; H01R 43/16; Y10T 29/49213

USPC ..... 439/284, 79, 701

See application file for complete search history.

(56) References Cited

U.S. PATENT DOCUMENTS 2,958,013 A * 10/1960 Ansley ..... H05K 1/14 361/728
3,008,112 A * 11/1961 Swengel ..... H05K 1/119 439/55
3,345,606 A * 10/1967 Scoville ..... H01R 4/4872 439/786

(Continued)

FOREIGN PATENT DOCUMENTS

DE 102 17 700 11/2003
WO WO 89/11169 11/1989

OTHER PUBLICATIONS

International Search Report for PCT/IB2012/052031, mailed Aug. 20, 2012.

(Continued)

*Primary Examiner* — Tulsidas C Patel
*Assistant Examiner* — Travis Chambers
(74) *Attorney, Agent, or Firm* — Nixon & Vanderhye P.C.

(57) ABSTRACT

The invention relates to a connector which includes basic parts that can be assembled and nested together, forming a high-density connector technology for hermaphroditic contacts.

14 Claims, 8 Drawing Sheets

(56) References Cited

U.S. PATENT DOCUMENTS 3,447,039 A * 5/1969 Branagan ..... H01R 4/50 174/265
3,601,759 A * 8/1971 Barker ..... H01R 13/193 439/262
4,392,705 A * 7/1983 Andrews, Jr. ..... H01R 12/89 439/259
4,513,064 A * 4/1985 Marcus ..... H05K 3/366 361/803
4,950,527 A * 8/1990 Yamada ..... 428/192
5,006,920 A * 4/1991 Schafer et al. ..... 257/700
5,052,953 A 10/1991 Weber
5,110,298 A * 5/1992 Dorinski ..... H01L 24/10 439/55
5,325,267 A * 6/1994 Ewing ..... 361/760
5,385,490 A 1/1995 Demeter et al.
5,736,191 A * 4/1998 Biernath ..... 427/98.2
5,741,148 A * 4/1998 Biernath ..... 439/284
6,053,744 A 4/2000 Gray et al.
6,068,518 A * 5/2000 McEuen ..... H01R 12/727 439/284
6,440,775 B2 * 8/2002 Khoury ..... 438/107
6,924,974 B2 * 8/2005 Stark ..... 361/679.01
7,221,868 B2 * 5/2007 Terada ..... G03B 17/00 396/542
7,532,484 B1 * 5/2009 Sailor ..... H01G 2/06 361/773
7,837,514 B2 * 11/2010 Fogg ..... H01R 13/514 439/701
8,314,338 B2 * 11/2012 Ishii et al. ..... 174/255
9,095,069 B2 * 7/2015 Stefanoff ..... H05K 1/142
2002/0080590 A1 * 6/2002 Bauermeister ..... H05K 1/142 361/803
2004/0214466 A1 * 10/2004 Lin ..... H05K 1/142 439/325
2006/0289201 A1 * 12/2006 Kim et al. ..... 174/261
2007/0155194 A1 * 7/2007 Vega Martinez ..... 439/62
2007/0275586 A1 11/2007 Ngo
2009/0044969 A1 * 2/2009 Ishii et al. ..... 174/255
2010/0124036 A1 * 5/2010 Schneider ..... H01G 2/04 361/782
2011/0303644 A1 * 12/2011 Macary ..... 216/83

OTHER PUBLICATIONS

Written Opinion of the International Searching Authority for PCT/IB2012/052031, mailed Aug. 20, 2012.

* cited by examiner

HIGH-DENSITY CONNECTOR

This application is the U.S. national phase of International Application No. PCT/IB2012/052031, filed 23 Apr. 2012, which designated the U.S. and claims priority to Swiss Application 00731/11, filed 29 Apr. 2011, the entire contents of each of which are hereby incorporated by reference.

TECHNICAL FIELD

The present invention relates to electrical connector technology. More specifically, the present invention relates to the connectors with a high density of contacts, for example of electrical contacts.

STATE OF THE ART

The products named Tyco Nanonics, Omnetics Nano metal shell, Glenair, Souriau Micro relate to circular connectors comprising up to 44 contacts and are known in the prior art.

Another example of high-density connector is known from the Tyco Electronics Corporation patent U.S. Pat. No. 7,632,126. This connector notably comprises a support plate which bears a plurality of electrical contacts which are aligned. The male part of the connector can contain a number of such plates, for example four, which are aligned in parallel and, correspondingly, the female part comprises receptacles which are also aligned in parallel, said receptacles containing contacts.

SUMMARY OF THE INVENTION

The aim of the invention is to improve the known systems.

More specifically, one aim of the invention is to propose a connector formed, for example, by an assembly of parts (for example made of plastic) that are partially metalized to allow for an extreme contact densification. The expression "contact density" should be understood to mean the number of contacts in relation to the overall bulk of the connector.

These days, the traditional contact manufacturing and assembly methods are reaching the physical limits for guaranteeing a quality that is perceived as average. Our own competition and experimental studies have shown that, to maintain a high quality level according to our standards, an alternative to the conventional methods was needed.

Thus, there is a first barrier to be overcome: how to maintain an industrially high quality level.

The connector system market offers a multitude of high-density connectors, such as the rectangular connector which supports the "HDMI" protocol for example. However, all these connectors, mainly rectangular, are constructed for "indoor" applications. They therefore offer little robustness to exposure to the outdoor environment, with an IP68 ingress protection function for example. It is possible to encapsulate them in order to make them more robust. A packaging notably increases the bulk, and the ingress protection is a function that is more difficult to guarantee on a rectangular design than a circular design, thus losing the advantage of a high contact density and simple functional design.

Therefore, there is a second barrier to be overcome: How to preserve a small footprint and a high contact density.

One option would be to manufacture with methods requiring significant investments, such as stamping, for example, which is widely used in the connector systems applied to consumer products. These methods therefore require applications that allow for a flow of large volumes which are more difficult to objectify in the industrial market.

There is therefore a third barrier to be overcome: How to rationalize the manufacturing to remain competitive.

To sum up, there are three challenges to be met:

1) Miniaturization
2) Functionality
3) Rationalization

To meet these challenges, the idea is to apply, in the first step of the connector manufacturing process according to the invention, a novel method for metalizing the surface by laser activation of the plastic, in the context of the MID (Molded Interconnect Device) technology.

This method consists in activating a plastic by laser, a technology known by the term LPKF-LDS (a technology of the company LPKF). This technology is described for example in the publication EP 1 191 127, the content of which is incorporated for reference in the present application. The next step is the metallization of the parts activated by the LPKF-LDS method by conventional galvanic bath methods. The final step is the assembly of the components.

The LPKF-LDS method provides the following advantages

1) Simple and inexpensive metallization of non-planar surface, impossible to obtain in conventional deposition or etching methods
2) Reduction of the number of parts to be manufactured
3) Significant reduction of the size of the parts while retaining high-quality functionalities.

One of the ideas of the present invention is to design parts that allow for a shrewd assembly and a particular design of the interpenetrated parts to form a high-density connector system that is simple to manufacture, that allows for a rationalization of the costs and makes it possible to obtain high quality functions which are these days difficult to obtain by conventional methods.

The duly formed connector is intended to be wired and to ensure a transfer of electricity.

BRIEF DESCRIPTION OF THE DRAWINGS

The invention will be better understood from the description of embodiments and the figures in which.

DETAILED DESCRIPTION

In the following description, the elements that are identical or similar will be identified by means of the same numeric references in the interests of simplification.

According to the present invention, in one embodiment, a support allowing for a high-density electrical connector is formed, preferably using two identical basic parts (for example made of plastic).

Figure 1:
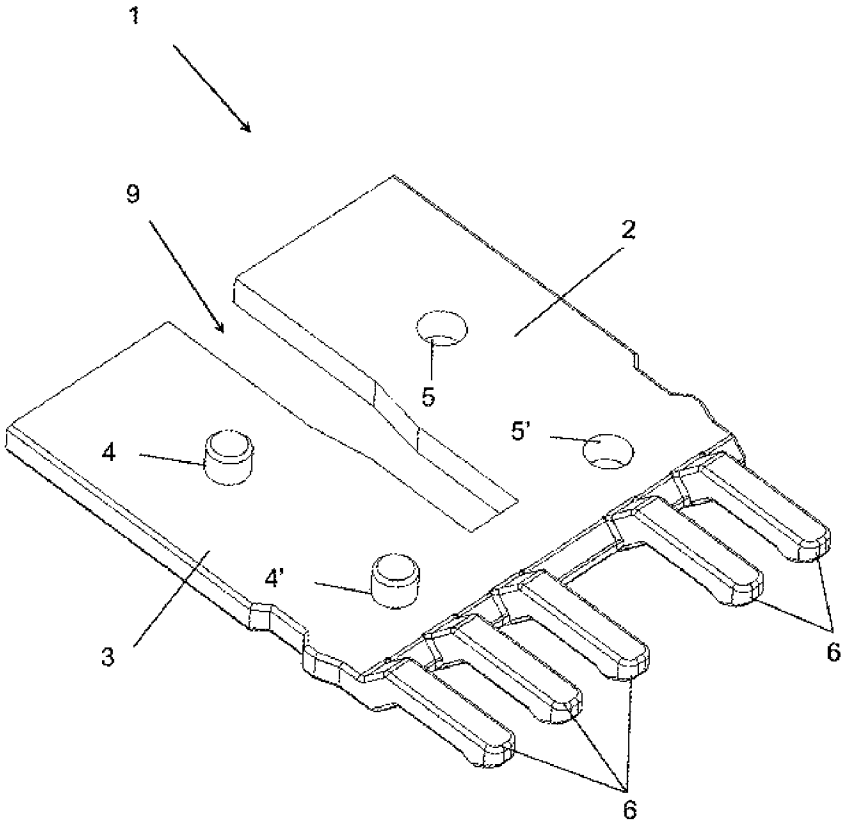
FIG. 1 shows a perspective view of the basic part.

FIG. 1 shows a general view from above of a basic part 1. This basic part 1 comprises, for example, two tabs 2, 3 that each have at least one stud 4, 4' and one alignment cavity 5, 5', the use of which will be explained later. At the end of the tabs 2, 3, there are contact fingers 6. In its "crude" state, the part 1 is, for example, made of plastic and it then undergoes a laser activation step in order to form the electrical contact tracks according to the method of the company LPKF-LDS mentioned above. Obviously, any appropriate material for the implementation of this method and the application of the present invention can be envisaged.

Figure 2:
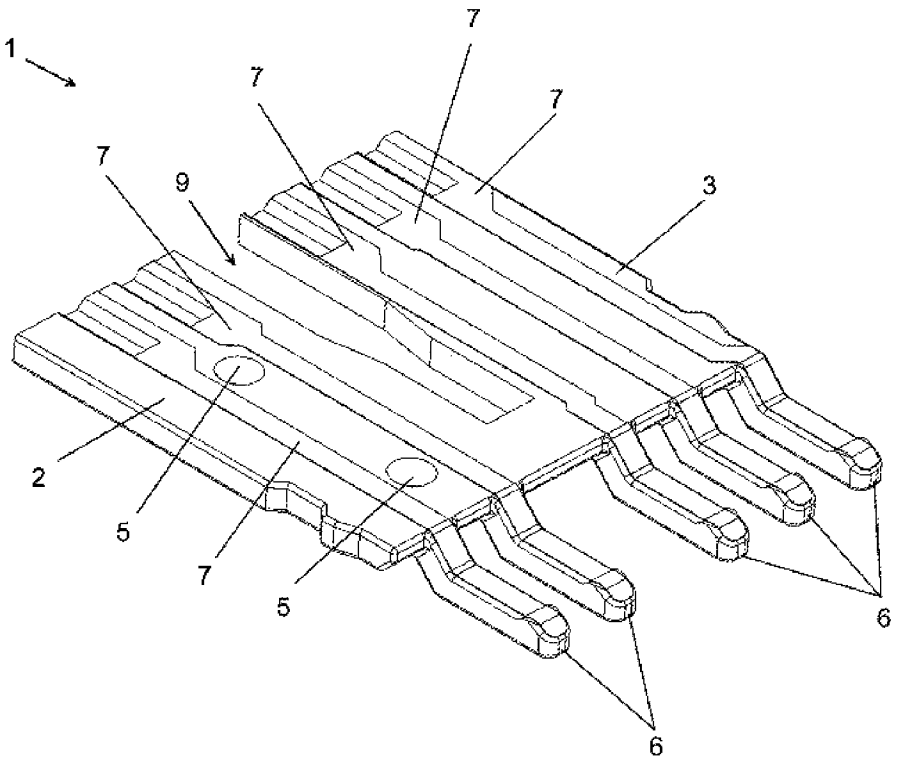
FIG. 2 shows a perspective view of the metallic coating.

FIG. 2 shows a general view from above. According to this embodiment of the invention, a metal coating has been deposited from one end to the other of the basic part 1. This coating forms a number of conductive and independent tracks 7 on the basic part by virtue of the laser activation method of the company LPKF-LDS.

Figure 3:
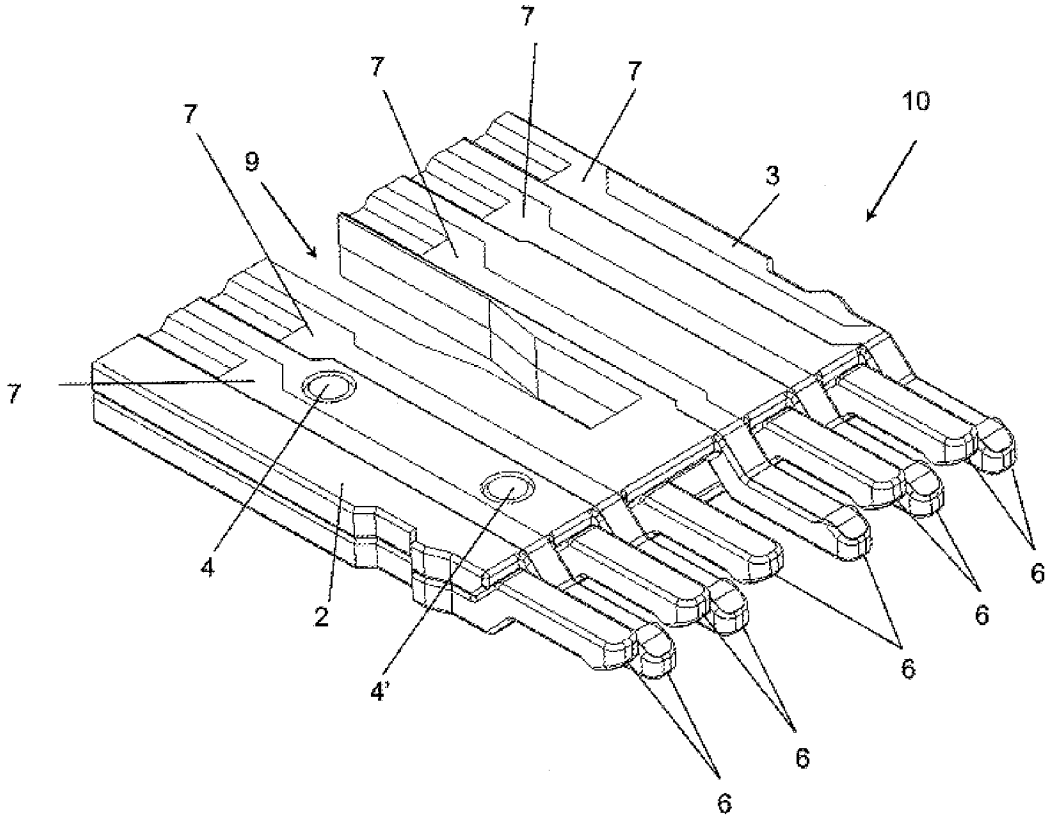
FIG. 3 shows a perspective view of the assembly formed from two identical basic parts.

As will be understood from FIGS. 1 and 2, given the asymmetrical arrangement of the fingers 6 (one tab 2 with two fingers 6, and the other tab 3 with three fingers 6), by turning over the part 1, it is possible to assemble two parts 1 together to obtain the configuration illustrated in FIG. 3 in which the fingers 6 are "nested" as illustrated, one alongside the other to form one element with ten adjacent contacts 6.

Furthermore, since the metalized tracks are present on the non-contiguous faces of the parts 1, there is no electrical contact between them and the isolation is guaranteed. Finally, through the nesting of the studs 4, 4' and the cavities 5, 5', a stable and aligned mounting of the two parts 1 is obtained.

At the limit, it is also possible to use only a single part 1 as illustrated in FIG. 2, but in this case contact density will be lost.

As indicated above, FIG. 3 shows a general view of a part 10 assembled from two basic parts 1. By construction, the two basic parts 1 are identical and assembled to form one part which contains conductive tracks on both its faces.

The electrical connection to a cable or another plug (straight or bent) can then be made on the rear side of the parts 1, that is to say, on the side away from the contacts 6.

This assembled part can be mounted in a support (rectangular or cylindrical) to form a connector and, as will be understood, it forms a hermaphroditic element which can be placed both in the male part and the female part of the connector.

Figure 4:
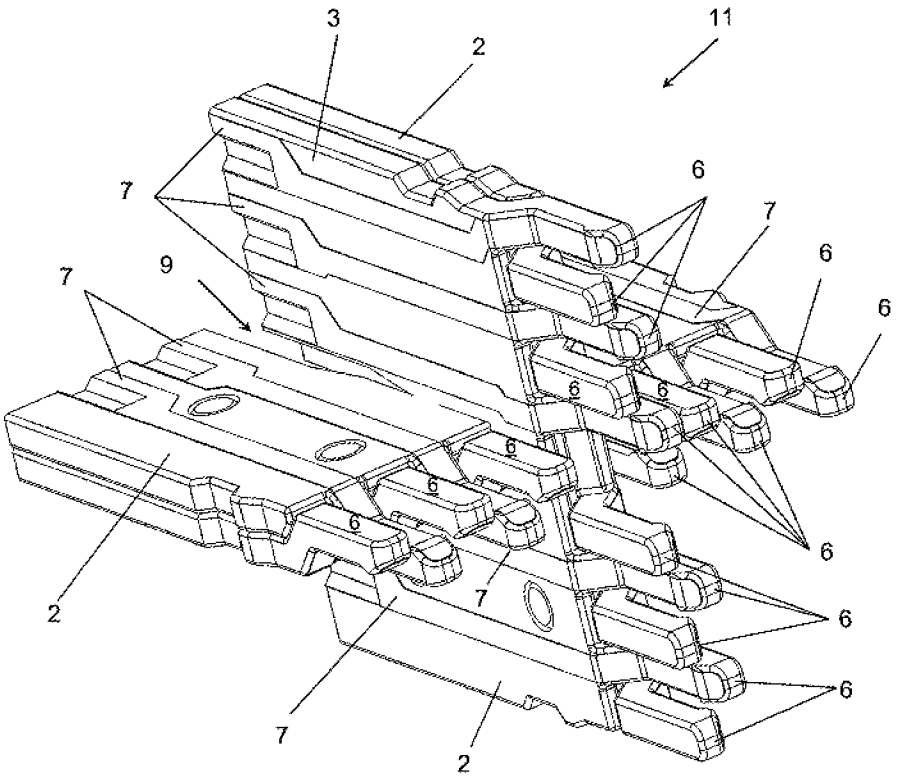
FIG. 4 shows a perspective view of the assembled electrical connector.

In another embodiment, the density of the electrical contacts can be increased (for example doubled) by mounting two parts in a cruciform nesting 11 which is illustrated in FIG. 4. This nesting can be done by using the slot 9 of the parts 1 (see FIGS. 1 and 2). Alternatively, such a geometrical configuration could be produced directly, without assembly, by an appropriate method, for example molding.

The advantage of this configuration is particularly evident for a cylindrical connector because the volume available easily allows for such a configuration.

Obviously, the invention is not limited to the embodiments of FIGS. 1 to 4 and other configurations are perfectly possible. It is notably possible to increase the number of nested parts and not be limited to a cruciform configuration (as in FIG. 4), but arrive at star configurations (with three or more nested parts), triangular configurations ("Toblerone" style), rectangular configurations, etc. In another variant, it is also possible to provide a stack of more than two parts 1, for example by stacking the structure 10 of FIG. 3 a number of times (see FIG. 7).

It is also possible to vary the number of fingers 6 used for the contacts.

As will be understood, numerous variants can be envisaged in the context of the present invention.

Figure 8:
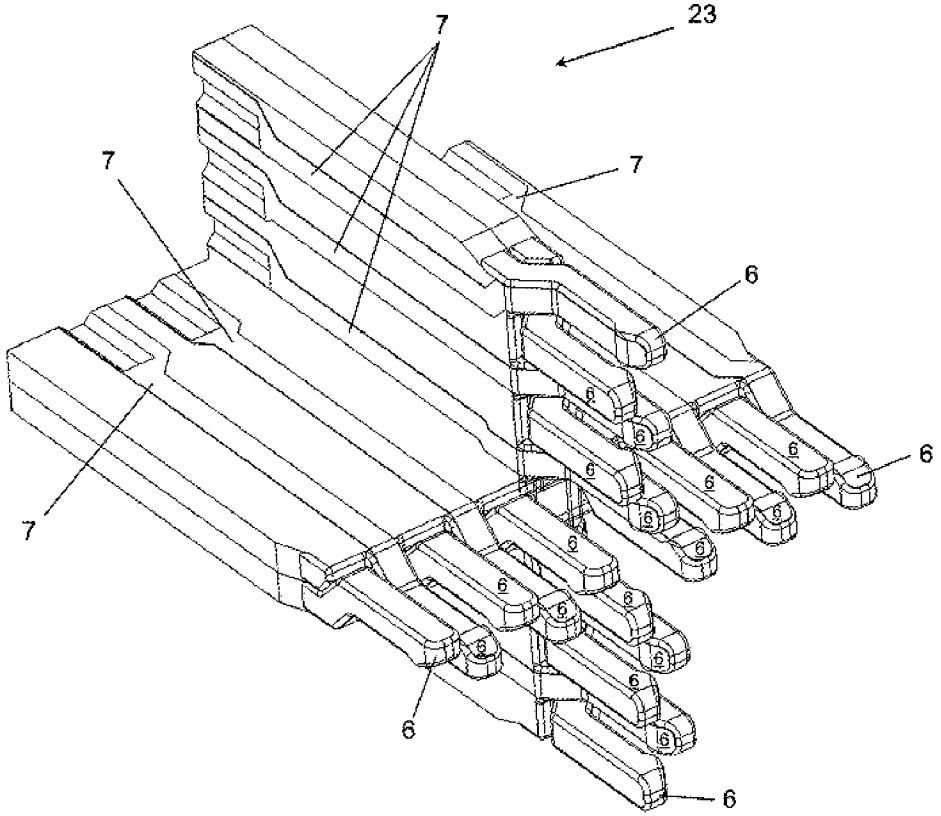
FIG. 8 shows a perspective view of another embodiment of the invention.

Alternatively, it is possible to start from a more complex structure than that of FIG. 1, for example from a cruciform structure (FIG. 4) or other structure, and to perform the metallization on this more complex structure. Such a structure could be produced by any suitable method (for example molding, prototyping, etc) and the laser activation and the metallization would be applied directly thereto. While this alternative does provide a saving on assembly, it nevertheless presents certain difficulties for the molding. An example of this variant produced in "a block" rather than by assembly is illustrated in FIG. 8. This figure shows a structure 23 which is equivalent to that of FIG. 4 with a cruciform support which bears the tracks 7 and the contact fingers 6. As will be observed by comparison, the embodiment of FIG. 8 is differentiated from that of FIG. 4 also in the frontal alignment of the contact fingers 6: in FIG. 4, the contact fingers 6 in the horizontal plane are set back relative to those in the vertical plane whereas, in FIG. 8, they are all aligned. In the embodiment of FIG. 4, this difference (which is not a defect and may be desired) is due to the nesting of the parts, notably to the form of the slot 9. Obviously, it is perfectly possible, in the context of the present invention, to modify the nesting (for example the slot 9) in such a way that this offset of the contact fingers 6 no longer appears and a version assembled starting from the parts of FIG. 3 is identical or similar to the embodiment illustrated in FIG. 8.

Figure 5:
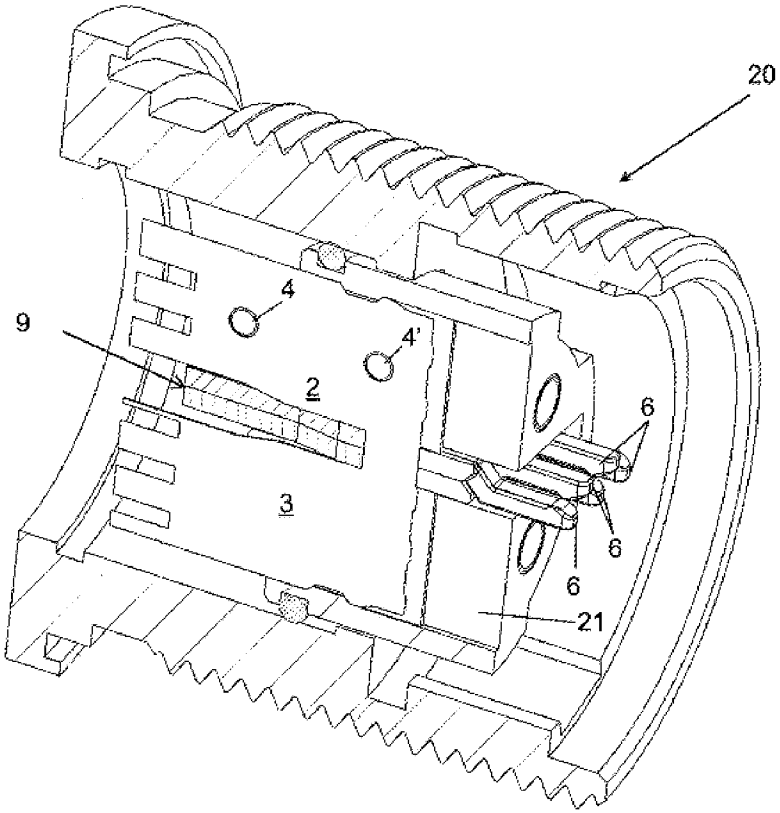
FIG. 5 shows a cross-sectional view of the electrical connector encapsulated in a metal housing.

FIG. 5 shows a general cross-sectional view in perspective of an electrical connector 20. According to one embodiment of the invention, the hermaphroditic electrical connector 20 is formed from two parts. The electrical connector system is provided by the flexibility of the contact fingers 6. The design of the contact fingers 6 is particularly studied to ensure an elastic deflection without long term creep. This connector is, for example, a connector which is sealed by screwing.

Figure 6:
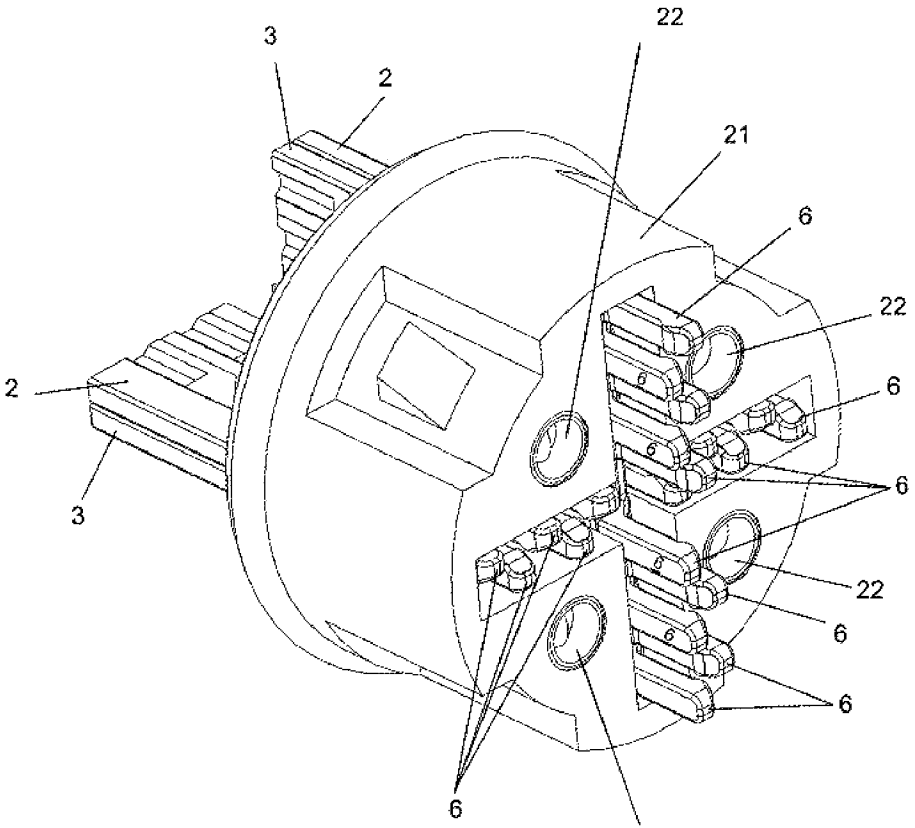
FIG. 6 shows a perspective view of the contact block.

FIG. 6 illustrates a perspective view of a part of the connector of FIG. 5, namely the contact block 21. As illustrated, this block contains a cruciform structure 10 (as a non limiting example, that of FIG. 4) and it also comprises four power contacts 22. This forms a connector with hybrid connection. Given the presence of these four power contacts 22, a cruciform structure is particularly well suited but other configurations are possible, as indicated above.

One of the advantages of the present invention, in addition to its simplicity, is also the fact that the assembled parts 1 are hermaphroditic, that is to say that it can be used both in the male part and in the female part of the connector, hence the significant gain.

As indicated above, the configurations are not limited to those illustrated in the figures by way of examples: the number of fingers for the contacts can be increased or reduced. Any material, preferably non conductive, can be chosen for the parts 1 provided that it can be used in the LPKF-LDS method.

Nor is the LPKF-LDS method the only method that can be used to produce the conductive tracks 7: other equivalent methods can perfectly well be envisaged. This method does, however, present the advantage of simplicity for producing complex tracks on surfaces which are not necessarily planar.

As already mentioned, the nesting is not necessarily limited to the cruciform (90°) configuration, but other angles and a number of nested parts are possible as is a stacking of more than two parts 1, or even triangular or rectangular, or any other desired form.

Figure 7:
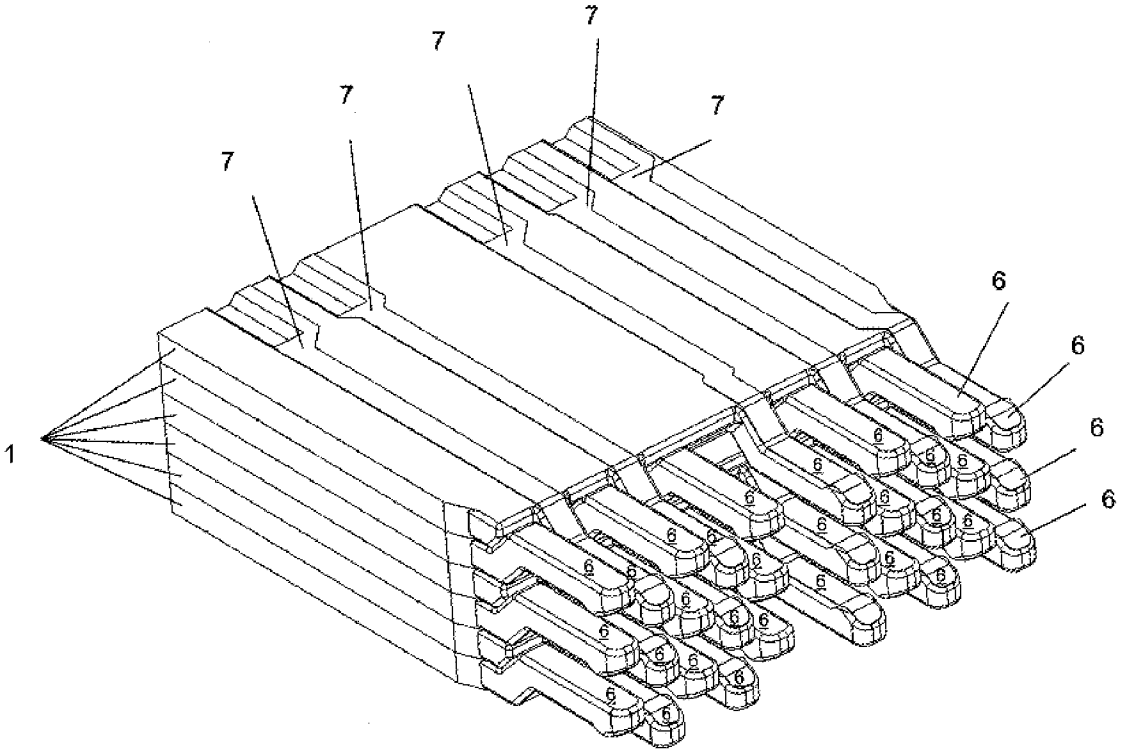
FIG. 7 shows a perspective view of another embodiment of the invention.

FIG. 7 illustrates an embodiment in which the parts 1 are stacked one on top of the other. The total number of parts is immaterial and can be chosen according to the circumstances. Preferably, their number is even. Alternatively, this stack can be produced en bloc (for example by molding, prototyping, etc) rather than by the assembly of individual parts 1.

FIG. 8 illustrates another embodiment which has been discussed in detail above.

Obviously, the embodiments described are not exclusive, in other words technical features of one can be applied to another.

Furthermore, the embodiments are illustrative examples which should not be considered to be limiting and variations are possible in the context of the protection claimed, for example by using equivalent means.

Furthermore, as described above, the structures (cruciform, stacked, etc) described above can be produced by the assembly of individual parts (formed by molding or other equivalent method) or else manufactured as a single part (en bloc) by any appropriate method, but it is also possible to envisage a hybrid construction which would be a combination of the two methods: for example, the structure 10 of FIG. 3 would be formed in one piece then two such structures would be assembled to obtain that of FIG. 4 or 8.

The treatment for the metallization (for example according to the method described above) can be performed on individual parts, individual structures or even after the assembly of the parts.

The invention claimed is:

1. A connector system comprising:

a first connector part having a planar body, a plurality of contact fingers, and a plurality of electrical contact tracks arranged on one side of the planar body and extending onto the contact fingers; and a second connector part having a planar body, a plurality of contact fingers, and a plurality of electrical contact tracks arranged on one side of the planar body and extending onto the contact fingers, wherein an electrical contact track from the plurality of electrical contact tracks extends from one side of a corresponding contact finger to a proximal end of the planar body, the proximal end being an end of the planar body that is opposite to the contact fingers, and wherein the first connector part and the second connector part are configured to be mechanically connected to each other without electrically connecting tracks from the first connector part with tracks from the second connector part.

2. The connector system according to claim 1, wherein no electrical contact tracks are arranged on an other side opposite the one side of the planar body and an other side of the plurality of contact fingers of both the first and second connector parts.

3. The connector system according to claim 1, wherein the first and the second connector parts are identical.

4. The connector system according to claim 1, wherein the first connector part and the second connector part each include a slot entering the planar body from the proximal end, wherein a width of the slot of the first connector part is configured such that the second connector part and a third connector part is lodged in the slot of the first connector part to arrange the first connector part and the second connector part perpendicular to each other to form a cruciform structure.

5. The connector system according to claim 1, wherein the planar body of the first connector part and the second connector part each include a stud and a cavity, wherein a position of the stud and the cavity on the planar body is such that the stud of the first connector part engages with the cavity of the second connector part, and the stud of the second connector part engages with the cavity of the first connector part, such that the first connector part and the second connector part can be fixed to each other to form a stack.

6. The connector system according to claim 1, wherein an axis of longitudinal extension of each of the contact fingers is arranged to be offset from a plane defined by an extension of the corresponding planar body.

7. The connector system according to claim 1, wherein the planar body of the first and the second connector parts each have a slot configured to attach the first connector part relative to the second connector part in a first position in which the planar body of the first connector part and the second connector part are arranged perpendicular towards each other to form a cruciform structure, and the planar body of the first and second connector parts each have an engagement device configured to attach the first connector part relative to the second connector part in a second position in which the planar body of the first and second connector parts are stacked.

8. The connector system according to claim 7, wherein in the second position, the two other sides that are each opposite the one side of the planar body of the first and second connector parts, respectively, are arranged to be in contact with each other.

9. The connector system according to claim 7, wherein an axis of longitudinal extension of each of the contact fingers is arranged to be offset from a plane defined by an extension of the corresponding planar body, the offset being defined such that the axis of longitudinal extension of a contact finger of the first connector part coincides with a plane defined by an extension of the planar body of the second connector part, when the first and second connector part are arranged in the second position.

10. A connector element comprising:

a planar body;

a plurality of contact fingers protruding form a distal end of the planar body;

a plurality of electrical contact tracks arranged on one side of the planar body, each electrical contact track extending onto one side of the contact fingers;

a slot protruding into the planar body from a proximal end of the planar body; and a snap-in mechanism arranged on the planar body, wherein each electrical contact track extends from a corresponding contact finger to the proximal end of the planar body, wherein axes of longitudinal extension of the plurality of contact fingers are arranged offset from a plane defined by an extension of the planar body.

11. The connector element according to claim 10, wherein a width of the slot is configured such that the connector element and another identical connector element can be lodged into the slot to form a cruciform structure.

12. The connector element according to claim 10, wherein the snap-in mechanism includes a cavity and a stud, dimensions of the cavity and the stud being such that a same shaped stud from another connector element can snap into the cavity.

13. The connector element according to claim 10, wherein each of the electrical contact tracks are arranged on a side of the planar body that faces away from an offset direction of the offset of the plurality of contact fingers, and an other side of the planar body is free of electrical contact tracks.

14. The connector element according to claim 10, wherein the offset corresponds to a thickness of the planar body.

* * * * *